US007641073B2

(12) United States Patent
Kim

(10) Patent No.: US 7,641,073 B2
(45) Date of Patent: Jan. 5, 2010

(54) APPARATUS AND METHOD FOR PREVENTING IRREGULAR PACKAGING FOR AUTOMATIC MEDICINE PACKING MACHINE

(75) Inventor: Jun Ho Kim, Taegu (KR)

(73) Assignee: JVM Co., Ltd., Taegu (KR)

( * ) Notice: Subject to any disclaimer, the term of this patent is extended or adjusted under 35 U.S.C. 154(b) by 541 days.

(21) Appl. No.: 11/624,012

(22) Filed: Jan. 17, 2007

(65) Prior Publication Data

US 2008/0104929 A1 May 8, 2008

(30) Foreign Application Priority Data

Nov. 2, 2006 (KR) ..... 10-2006-0107961

(51) Int. Cl.
*G07F 11/00* (2006.01)

(52) U.S. Cl. ..... 221/171; 221/173; 221/174; 221/200

(58) Field of Classification Search ..... 221/171, 221/173, 174, 200
See application file for complete search history.

(56) References Cited

U.S. PATENT DOCUMENTS

| | | | |
|---|---|---|---|
| 169,935 | A | 11/1875 | Whitman |
| 350,675 | A | 10/1886 | Hathaway |
| 488,721 | A | 12/1892 | Stempel |
| 1,121,804 | A | 12/1914 | Coulson |
| 1,270,756 | A | 6/1918 | Holmberg |
| 1,912,248 | A | 5/1933 | Bateman et al. |
| 2,005,496 | A | 6/1935 | Donovan et al. |
| 2,181,314 | A | 11/1939 | Burns |
| 2,208,951 | A | 7/1940 | Tamassy |
| 2,255,036 | A | 9/1941 | Gedge |
| 2,449,139 | A | 9/1948 | Posner |
| 2,710,712 | A | 6/1955 | Friedman |
| 2,712,883 | A | 7/1955 | Esposito et al. |
| 2,918,069 | A | 12/1959 | Brown, Jr. et al. |
| 2,994,996 | A | 8/1961 | Klar |
| 3,074,214 | A | 1/1963 | Schneider et al. |
| 3,227,127 | A | 1/1966 | Gayle |
| 3,263,857 | A | 8/1966 | Krakauer et al. |
| 3,348,392 | A | 10/1967 | Schreiber |

(Continued)

FOREIGN PATENT DOCUMENTS

| | | |
|---|---|---|
| GB | 2178397 | 2/1987 |

(Continued)

*Primary Examiner*—Gene Crawford
*Assistant Examiner*—Timothy R Waggoner
(74) *Attorney, Agent, or Firm*—John K. Park; Park Law Firm

(57) ABSTRACT

A method for preventing irregular packaging for automatic medicine packing machine having a last hopper that contains the tablet just before the tablet is packed, includes steps of sensing whether a tablet is received in the last hopper, sensing and deciding whether the tablet stands vertical inside the last hopper, vibrating a shutter if it is decided that the tablet stands vertical whereby the vertical standing tablet falls down, and checking non-standing of the tablet after completion of shutter vibration. The apparatus performing the method includes a shutter vibrating unit and a standing sensor that is installed on the last hopper and senses whether the tablet received in the last hopper stands vertical. The standing sensor includes a horizontal slot that is formed horizontally at a side of the last hopper at a position corresponding to a vertical height of a tablet and a photo sensor.

8 Claims, 10 Drawing Sheets

U.S. PATENT DOCUMENTS

| | | | | |
|---|---|---|---|---|
| 3,408,876 | A | | 11/1968 | Andrews |
| 3,410,452 | A | | 11/1968 | Igel et al. |
| 3,481,103 | A | | 12/1969 | Summerour |
| 3,546,849 | A | | 12/1970 | Zimmerman |
| 3,562,475 | A | | 2/1971 | Angelotti et al. |
| 3,604,559 | A | | 9/1971 | McCall et al. |
| 3,774,368 | A | | 11/1973 | Paprzycki et al. |
| 3,820,655 | A | | 6/1974 | La Tourette et al. |
| 3,830,419 | A | | 8/1974 | Lee |
| 3,842,569 | A | | 10/1974 | McClelland et al. |
| 3,850,780 | A | | 11/1974 | Crawford et al. |
| 3,861,651 | A | | 1/1975 | Takamura |
| 3,871,156 | A | | 3/1975 | Koenig et al. |
| 3,917,025 | A | * | 11/1975 | Yates et al. ..... 188/52 |
| 3,921,419 | A | | 11/1975 | Rosenkranz et al. |
| 3,990,209 | A | | 11/1976 | Eisenberg |
| 4,019,547 | A | | 4/1977 | Ross |
| 4,149,394 | A | | 4/1979 | Sornes |
| 4,209,211 | A | | 6/1980 | Alford |
| 4,244,158 | A | | 1/1981 | Nelham |
| 4,254,601 | A | | 3/1981 | Prager et al. |
| 4,267,942 | A | | 5/1981 | Wick, Jr. et al. |
| 4,382,527 | A | | 5/1983 | Lerner |
| 4,519,179 | A | | 5/1985 | Meier |
| 4,534,499 | A | | 8/1985 | Cox et al. |
| 4,572,376 | A | | 2/1986 | Wrennall |
| 4,664,289 | A | | 5/1987 | Shimizu et al. |
| 4,696,392 | A | | 9/1987 | Chisholm, Jr. |
| 4,771,912 | A | | 9/1988 | van Wingerden |
| 4,790,118 | A | | 12/1988 | Chilcoate |
| 4,790,421 | A | | 12/1988 | Gorges |
| 4,811,764 | A | | 3/1989 | McLaughlin |
| 4,903,861 | A | | 2/1990 | Yuyama |
| 4,915,259 | A | | 4/1990 | Guigan et al. |
| 4,922,682 | A | | 5/1990 | Tait et al. |
| 4,955,178 | A | | 9/1990 | Shroyer |
| 5,069,511 | A | | 12/1991 | Swets et al. |
| 5,097,652 | A | | 3/1992 | Inamura et al. |
| 5,219,095 | A | | 6/1993 | Shimizu et al. |
| 5,221,024 | A | | 6/1993 | Campbell |
| 5,318,430 | A | | 6/1994 | Ramm |
| 5,337,919 | A | | 8/1994 | Spaulding et al. |
| 5,348,061 | A | | 9/1994 | Riley et al. |
| 5,381,904 | A | | 1/1995 | Thurell |
| 5,383,559 | A | | 1/1995 | Toren |
| 5,413,245 | A | | 5/1995 | Wright |
| 5,441,165 | A | | 8/1995 | Kemp et al. |
| 5,459,983 | A | | 10/1995 | Sadek et al. |
| 5,481,855 | A | | 1/1996 | Yuyama |
| 5,487,289 | A | | 1/1996 | Otto, III et al. |
| 5,502,944 | A | | 4/1996 | Kraft et al. |
| 5,509,573 | A | | 4/1996 | Campoli |
| 5,522,525 | A | | 6/1996 | McLaughlin et al. |
| 5,575,465 | A | | 11/1996 | Auerbach et al. |
| 5,588,792 | A | | 12/1996 | Tiso |
| 5,599,015 | A | | 2/1997 | Shimizu et al. |
| 5,611,456 | A | | 3/1997 | Kasper |
| 5,626,219 | A | | 5/1997 | Deefholts et al. |
| 5,651,476 | A | | 7/1997 | Percy et al. |
| 5,660,305 | A | | 8/1997 | Lasher et al. |
| 5,667,096 | A | | 9/1997 | Wu |
| 5,671,592 | A | | 9/1997 | Yuyama et al. |
| 5,678,393 | A | | 10/1997 | Yuyama et al. |
| 5,709,063 | A | | 1/1998 | Yuyama et al. |
| 5,722,215 | A | | 3/1998 | Yuyama |
| 5,749,117 | A | | 5/1998 | Forsline |
| 5,765,606 | A | | 6/1998 | Takemasa et al. |
| 5,787,678 | A | | 8/1998 | Koike et al. |
| 5,797,248 | A | | 8/1998 | Hetherington et al. |
| 5,803,309 | A | | 9/1998 | Yuyama et al. |
| 5,819,500 | A | | 10/1998 | Haraguchi et al. |
| 5,839,257 | A | | 11/1998 | Soderstrom et al. |
| 5,852,911 | A | | 12/1998 | Yuyama et al. |
| 5,865,342 | A | | 2/1999 | Ito et al. |
| 5,875,610 | A | | 3/1999 | Yuyama et al. |
| 5,901,876 | A | | 5/1999 | Yuyama et al. |
| 5,927,546 | A | | 7/1999 | Yuyama et al. |
| 5,930,145 | A | | 7/1999 | Yuyama et al. |
| 5,944,057 | A | | 8/1999 | Pierce |
| 5,946,883 | A | | 9/1999 | Yuyama et al. |
| 5,963,453 | A | | 10/1999 | East |
| 5,964,374 | A | | 10/1999 | Yuyama et al. |
| 5,987,859 | A | | 11/1999 | Dreger |
| 6,012,602 | A | | 1/2000 | Yuyama et al. |
| 6,023,916 | A | | 2/2000 | Bouthiette |
| 6,029,683 | A | | 2/2000 | Moebs et al. |
| 6,050,064 | A | | 4/2000 | Yuyama et al. |
| 6,089,136 | A | | 7/2000 | Hinojosa et al. |
| 6,109,486 | A | | 8/2000 | Lee, Jr. et al. |
| 6,119,440 | A | | 9/2000 | Benner, Jr. et al. |
| 6,119,892 | A | | 9/2000 | Laurent et al. |
| 6,145,700 | A | | 11/2000 | Takahashi et al. |
| 6,164,038 | A | | 12/2000 | Kim |
| 6,170,229 | B1 | | 1/2001 | Kim |
| 6,170,230 | B1 | | 1/2001 | Chudy et al. |
| 6,170,699 | B1 | | 1/2001 | Kim |
| 6,179,205 | B1 | | 1/2001 | Sloan |
| 6,202,385 | B1 | | 3/2001 | Kim |
| 6,216,418 | B1 | | 4/2001 | Kim |
| 6,256,963 | B1 | | 7/2001 | Kim |
| 6,263,639 | B1 | | 7/2001 | Kim |
| 6,273,335 | B1 | | 8/2001 | Sloan |
| 6,308,494 | B1 | | 10/2001 | Yuyama et al. |
| 6,311,743 | B1 | | 11/2001 | Baroncini |
| 6,318,051 | B1 | | 11/2001 | Preiss |
| 6,349,848 | B1 | | 2/2002 | Uema et al. |
| 6,364,517 | B1 | | 4/2002 | Yuyama et al. |
| 6,367,232 | B2 | | 4/2002 | Kim |
| 6,394,308 | B1 | | 5/2002 | Yuyama et al. |
| 6,409,290 | B1 | | 6/2002 | Lin |
| 6,427,865 | B1 | | 8/2002 | Stillwell et al. |
| 6,449,921 | B1 | | 9/2002 | Kim |
| 6,457,611 | B1 | | 10/2002 | Koehler |
| 6,471,089 | B2 | | 10/2002 | Liff et al. |
| 6,471,090 | B1 | | 10/2002 | Inamura et al. |
| 6,478,185 | B2 | | 11/2002 | Kodama et al. |
| 6,481,180 | B1 | | 11/2002 | Takahashi et al. |
| 6,508,279 | B2 | | 1/2003 | Siegel et al. |
| 6,540,101 | B1 | | 4/2003 | Kim |
| 6,581,356 | B2 | | 6/2003 | Kim |
| 6,585,132 | B2 | | 7/2003 | Kim |
| 6,604,019 | B2 | | 8/2003 | Ahlin et al. |
| 6,611,733 | B1 | | 8/2003 | De La Huerga |
| 6,644,504 | B2 | | 11/2003 | Yuyama et al. |
| 6,647,702 | B1 | | 11/2003 | Kim |
| 6,722,167 | B1 | | 4/2004 | Hsu |
| 6,772,907 | B2 | | 8/2004 | Kim |
| 6,786,356 | B2 | | 9/2004 | Geiger et al. |
| 6,792,736 | B1 | | 9/2004 | Takahashi |
| 6,805,259 | B2 | | 10/2004 | Stevens et al. |
| 6,877,611 | B2 | * | 4/2005 | Yamamoto et al. ..... 209/646 |
| 6,898,919 | B2 | | 5/2005 | Kim |
| 7,028,447 | B2 | | 4/2006 | Sung |
| 7,059,098 | B2 | | 6/2006 | Kim |
| 7,331,151 | B2 | | 2/2008 | Kim |
| 7,523,594 | B2 | * | 4/2009 | Greenwald et al. ..... 53/255 |
| 2002/0092275 | A1 | | 7/2002 | Kim |
| 2003/0057225 | A1 | | 3/2003 | Kim |
| 2003/0074868 | A1 | | 4/2003 | Yasuoka et al. |
| 2004/0046020 | A1 | | 3/2004 | Andreasson et al. |
| 2004/0129716 | A1 | | 7/2004 | Naufel et al. |
| 2004/0182044 | A1 | | 9/2004 | Kim |
| 2005/0179349 | A1 | | 8/2005 | Booth et al. |
| 2005/0234430 | A1 | | 10/2005 | Mao et al. |

| | | | |
|---|---|---|---|
| 2006/0058918 | A1 | 3/2006 | Handfield et al. |
| 2006/0070352 | A1 | 4/2006 | Momich |
| 2006/0139148 | A1 | 6/2006 | Faro et al. |
| 2006/0267727 | A1 | 11/2006 | Cayne et al. |
| 2006/0273106 | A1 | 12/2006 | Kim |
| 2007/0016327 | A1 | 1/2007 | Yuyama et al. |
| 2007/0078562 | A1 | 4/2007 | Park |
| 2007/0125100 | A1 | 6/2007 | Shoenfeld |
| 2007/0151204 | A1 | 7/2007 | Kim |
| 2007/0208595 | A1 | 9/2007 | Ohmura et al. |
| 2007/0257773 | A1 | 11/2007 | Hill et al. |

FOREIGN PATENT DOCUMENTS

| | | |
|---|---|---|
| JP | 9-175510 | 7/1997 |
| JP | 9-266940 | 10/1997 |

* cited by examiner (PRIOR ART)

(PRIOR ART)

(PRIOR ART)

APPARATUS AND METHOD FOR PREVENTING IRREGULAR PACKAGING FOR AUTOMATIC MEDICINE PACKING MACHINE

CLAIMING FOREIGN PRIORITY

The applicant claims and requests a foreign priority, through the Paris Convention for the Protection of Industrial Property, based on patent applications filed in the Republic of Korea (South Korea) with the filing date of Nov. 2, 2006 with the patent application number 10-2006-0107961 by the applicant, the contents of which are incorporated by reference into this disclosure as if fully set forth herein.

BACKGROUND OF THE INVENTION

The present invention relates to method and apparatus for preventing irregular packaging in an automatic medicine packing machine. More particularly, the present invention relates to method and apparatus for vibrating a last hopper of an automatic medicine packing machine for preventing irregular packing in which a tablet stands vertical.

FIG. 7 shows an automatic medicine packing machine by prior art. The machine includes a plurality of tablet cassettes 200 that are installed in shelves that are provided in the upper part of a main body 100, a hopper 300 that is provided below the tablet cassettes 200 and has a last hopper 301 on its lower end, a pair of packing envelope rolls 400 provided on both sides of and below the hopper 300, a printing unit 500 that is provided below the rolls 400 and prints prescription, administering and patient information, a pair of feed rollers 600 that are provided below the hopper, a sealing unit 700 forming a bundle of packed envelopes by heat sealing the envelopes and provided between the hopper and the feed rollers, a punching unit 800 that punches holes on the bundle of envelopes and is provided below the sealing unit. In the operation of the machine, tablets discharged from the tablet cassette 200 to the hopper 300 are collected in the last hopper 301, and all the tablets are discharged at once and received in an envelope that is fed from the packing envelope roll 400 by the feed rollers 600. The envelope carrying the tablets is sealed by the sealing unit 700 while the envelope is moving downward, and the sealed envelope is discharged to the lower portion of the main body 100.

As shown in FIGS. 8 and 9, the last hopper 301 and a shutter driver unit 303 are installed on a main frame 101. The shutter driver unit 303 opens/closes a shutter 302 for the last hopper 301. The shutter driver unit 303 is operated as follows. A motor 303*a* rotates a rotating member 303*b* by a predetermined angle. Then an angular movement pin 303*c* is angularly moved and pushes a trigger 302*a* by a predetermined angle and thereby rotating a rotating pin 302*b* that is coupled to the trigger 302*a*, and the shutter 302 that is coupled to the rotating pin 302*b* is rotated. In this way, a lower part of the last hopper 301, which has been closed by the shutter 302, is opened and a tablet T that was contained in the last hopper is discharged between the pair of the packing envelope P. The tablet T discharged on the packing envelope P is packed by heat sealing of the envelope with the sealing unit 700.

To close the last hopper 301 again, the motor 303*a* is rotated to its initial position. Then the angular movement pin 303*c* is rotated back and return to its initial position. Then the pushing of the trigger 302*a* by the angular movement pin 303*c* is removed and elastic force by a torsion spring 302*c* that was pressing the rotating pin 302*b* is removed thereby returning the rotating pin 302*b* and returning the shutter 302 to its original position.

The disadvantage of the prior art is that when an elongate tablet like a capsule is positioned vertical in the last hopper, the vertically standing tablet falls down when the shutter is open, and remains vertical on the packing envelope. In this case, the upper end of the tablet is pressed by the sealing unit and may be broken or damaged. This break or damage is more frequent for a large tablet that is packed alone.

SUMMARY OF THE INVENTION

The present invention contrives to solve the disadvantages of the prior art.

An objective of the invention is to provide a simple apparatus and method for preventing vertical standing of a tablet in a last hopper of an automatic medicine packing machine, thereby preventing erroneous packing and break or damage of a tablet.

Another objective of the invention is to provide a last hopper vibration device that can be easily installed on an existing automatic medicine packing machine.

Still another objective of the invention is to provide a last hopper vibration device that senses whether a tablet stands vertical, and vibrates a last hopper only when a tablet stands vertical.

In order to achieve the above objective, the present invention provides a method for preventing irregular packaging for automatic medicine packing machine that comprises a last hopper that receives a tablet discharged from a tablet cassette and contains the tablet just before the tablet is packed. The last hopper comprises a shutter. The method comprises the steps of sensing whether a tablet is received in the last hopper, sensing and deciding whether the tablet stands vertical inside the last hopper, vibrating the shutter for a predetermined period of time if it is decided that the tablet stands vertical whereby the vertical standing tablet falls down, and checking non-standing of the tablet, in which checking vertical standing of the tablet is performed with the standing sensor after completion of shutter vibration.

In the step of sensing and deciding whether the tablet stands vertical, a photo sensor that is provided on the last hopper performs sensing standing status of the tablet.

In another embodiment, a method for preventing irregular packaging for automatic medicine packing machine that comprises the steps of sensing whether a tablet was discharged from the tablet cassette into the last hopper and stays inside the last hopper, extracting size information of the tablet that is input into the last hopper from medicine data that is stored in a controller in advance, comparing the extracted size of the tablet with a reference tablet size that is preset by an operator of the automatic medicine packing machine, and vibrating the shutter for a predetermined period of time if it is decided that the extracted size exceeds the reference tablet size.

The present invention also provides an apparatus for preventing irregular packaging for automatic medicine packing machine that comprises a last hopper that receives a tablet discharged from a tablet cassette and contains the tablet just before the tablet is packed. The last hopper comprises a shutter and a shutter drive unit that actuates the shutter to discharge the tablet. The apparatus comprises a shutter vibrating unit that is provided on an outer surface of the shutter and vibrates the shutter to prevent vertical standing of a tablet received in the last hopper.

The shutter vibrating unit comprises a vibration motor that is provided on the outer surface of the shutter and generates vibration and a fixing frame that fixes the vibration motor to the outer surface of the shutter so that the vibration motor is in close contact with the outer surface.

The apparatus further comprises a standing sensor that is installed on the last hopper and senses whether the tablet received in the last hopper stands vertical.

The standing sensor comprises a horizontal slot that is formed horizontally at a side of the last hopper at a position corresponding to a vertical height of a tablet and a photo sensor that is horizontally arranged in the horizontal slot and senses vertical standing of the tablet.

The advantages of the present invention are: (1) the present invention provides a simple method and apparatus that prevents vertical standing of a tablet in a last hopper, irregular packaging caused by vertical standing tablet, and break or damage of a tablet caused by packing vertical standing tablet; (2) the apparatus is easy to assemble and install in an existing automatic medicine packing machine, and operational stability is improved when the last hopper is vibrated; and (3) noise and damage of the apparatus is substantially reduced since the vibration of the last hopper is performed only when it is sensed that the tablet stands vertical, and thus unnecessary vibration is not repeated.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
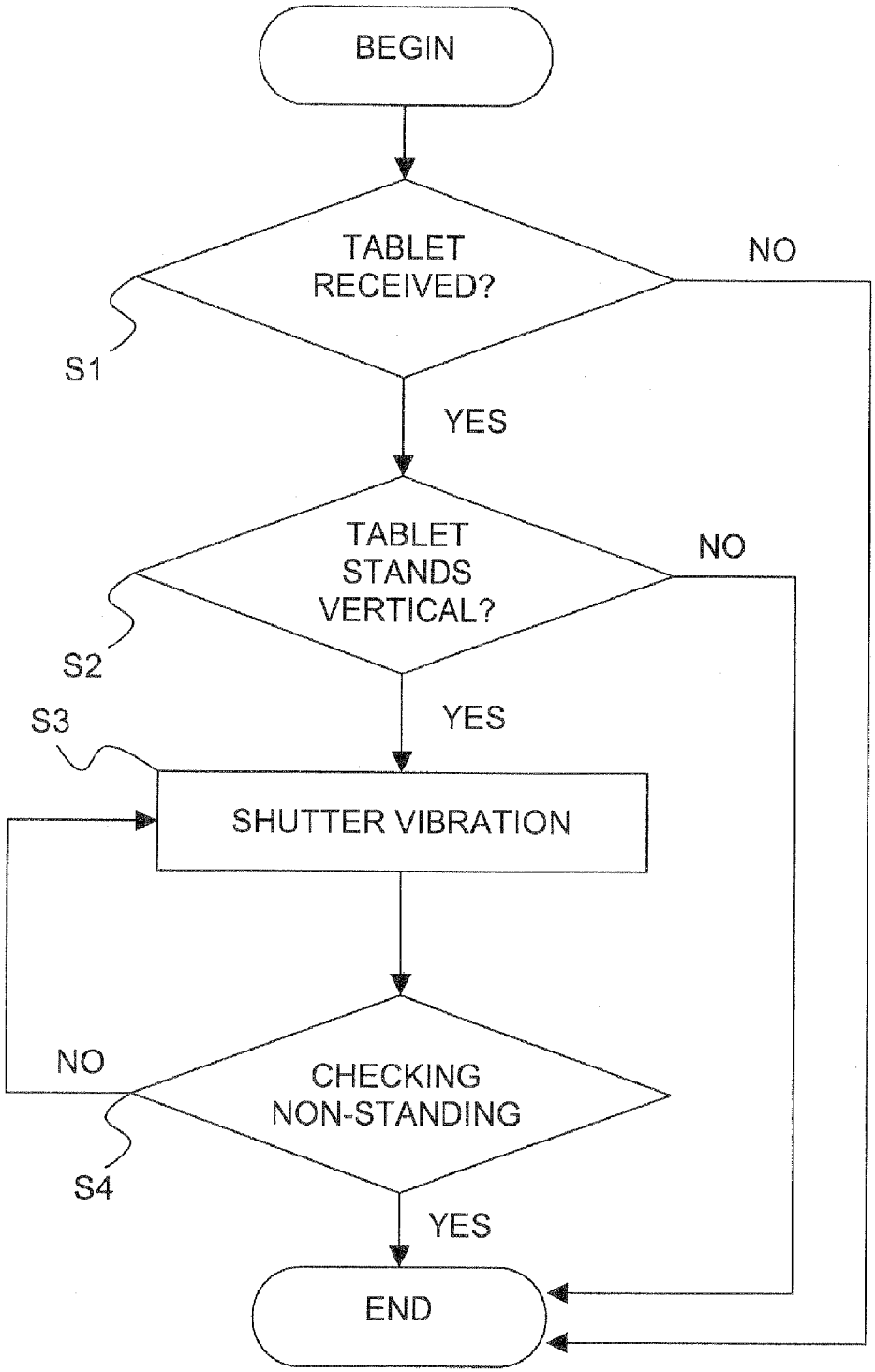
FIG. 1 is a flow diagram showing a method of preventing irregular packaging of an automatic medicine packing machine.

FIG. 1 shows a method for preventing erroneous packing of medicine. The method includes step S1 of sensing whether a tablet is received in a last hopper, step S2 of deciding whether the tablet stands vertical inside the last hopper, and step S3 of vibrating a shutter if the tablet stands vertical so that the tablet is discharged from the last hopper not in vertical standing state.

Figure 10:
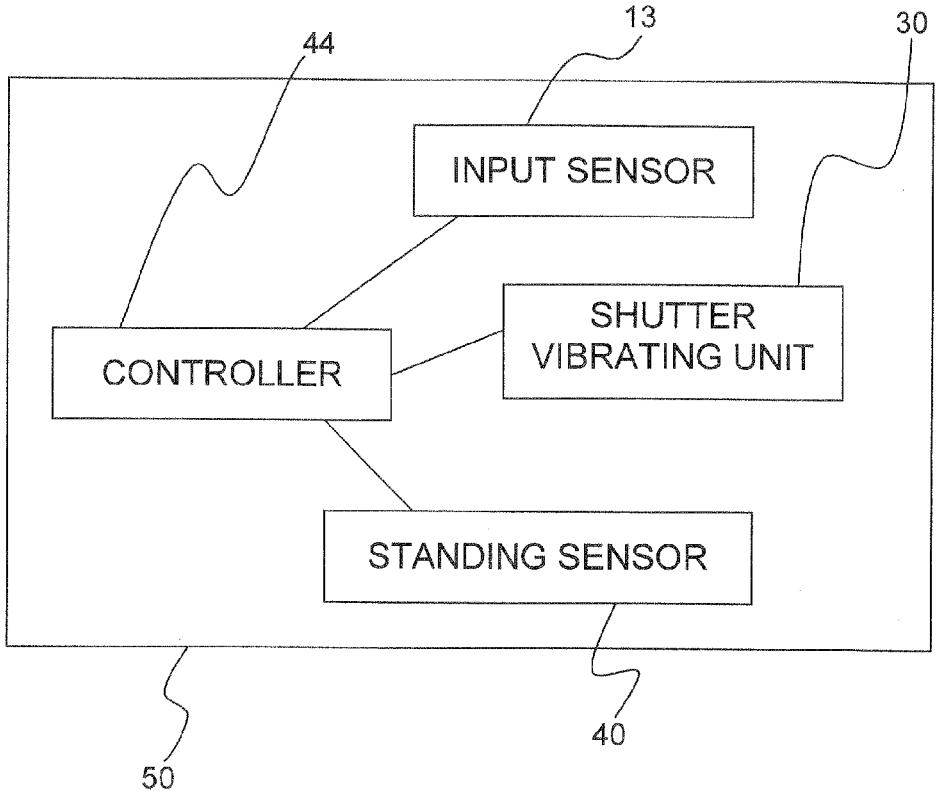
FIG. 10 is a block diagram showing an apparatus for preventing irregular packaging of an automatic medicine packing machine.

In step S1, whether a tablet was discharged from a tablet cassette into the last hopper and stays inside the last hopper is sensed with an input sensor 13 (refer to FIG. 10). This step is to recognize that situation that a tablet is input into the last hopper.

After the input sensor senses that a tablet is received, in step S2, the positional status of the tablet inside the last hopper is sensed with a standing sensor 40 (refer to FIG. 10), and whether the tablet stands vertical is decided from the sensed information with a controller 44 (refer to FIG. 10). The standing sensor is a photo sensor that is installed in the last hopper, and senses the upper end of the tablet which is exposed when the tablet stands vertical (refer to FIGS. 5 and 6).

If it is decided that the tablet stands vertical, in step S3, the shutter is vibrated for a predetermined period of time so that the standing tablet falls down. If it is decided that the tablet does not stand vertical, the shutter is not vibrated in step S3.

The method further includes step S4 of checking non-standing of the tablet, in which checking vertical standing of the tablet is performed with the standing sensor after completion of shutter vibration. If the tablet still stands vertical, the shutter is vibrated again.

Figure 2:
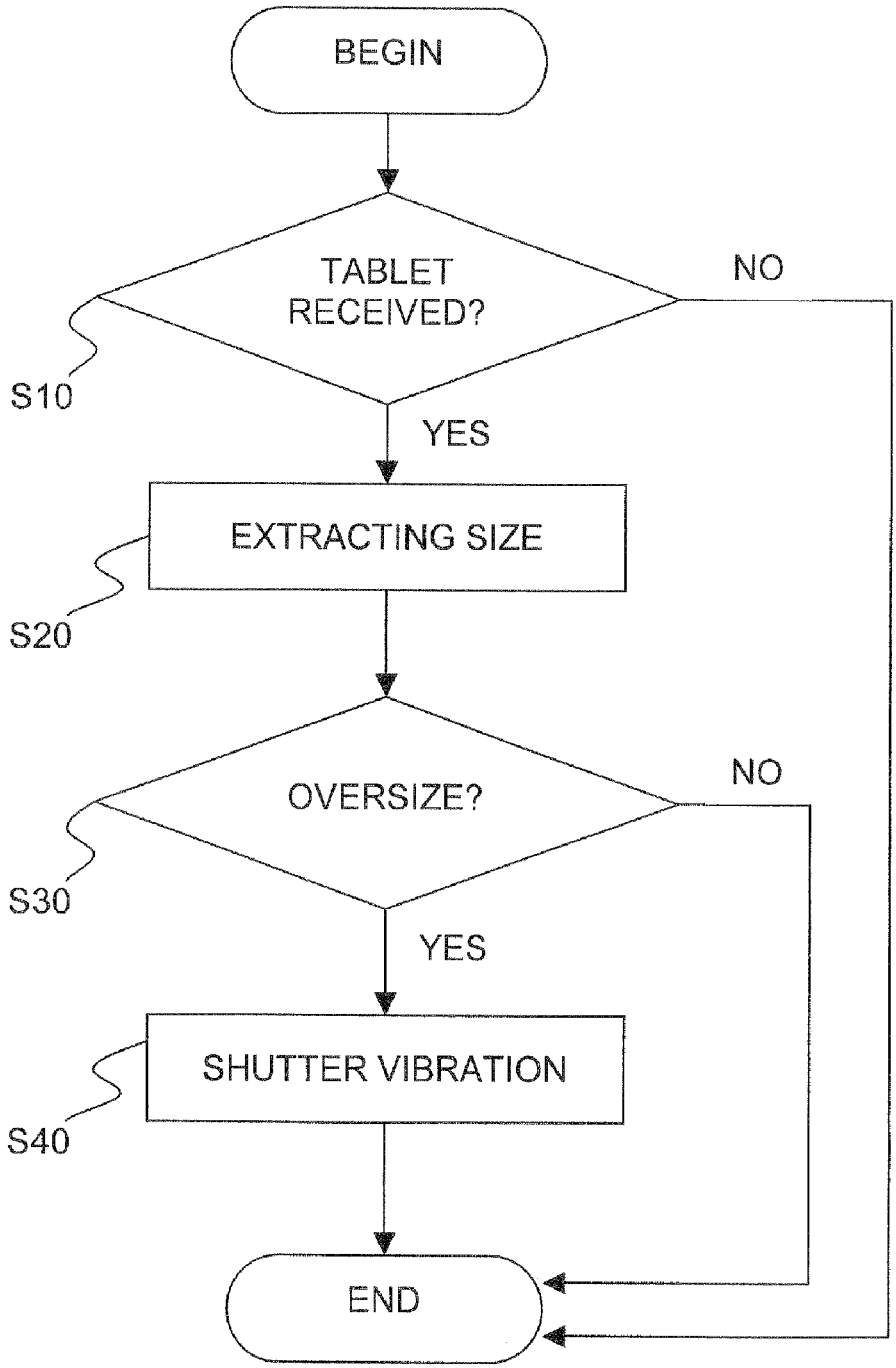
FIG. 2 is a flow diagram for a second embodiment.

FIG. 2 shows another embodiment of a method preventing erroneous packaging of medicine. The method includes step S10 of sensing whether a tablet is received in the last hopper, step S20 of extracting tablet size information, in which tablet size information is extracted, step S30 of deciding oversize of tablet, in which whether the size of the tablet exceeds the predetermined size is decided, and step S40 of vibrating the shutter if the size of the tablet exceeds the predetermined size. These steps are performed sequentially to prevent the tablet from being discharged standing vertical.

In step S10, whether a tablet was discharged from the tablet cassette into the last hopper and stays inside the last hopper is sensed with the input sensor. This step is to recognize that situation that a tablet is input into the last hopper.

In step S20, size information about the size of the tablet that is input into the last hopper is extracted from the medicine data that is stored in the controller in advance to compare with a reference size of a tablet that is preset in the controller.

Generally, the size of a tablet stored in the medicine data includes three classes, large, medium and small.

In step S30, the extracted size of the tablet obtained from the medicine data of the tablet is compared with the reference tablet size that is preset by the operator. For example, under situation that the operator set the reference tablet size as medium, when the extracted size for the tablet received in the last hopper is large, it is decided that size of the tablet received in the last hopper exceeds the reference tablet size.

In step S40, the shutter is vibrated for a predetermined period of time to fall down the tablet if it is decided that the extracted size exceeds the reference tablet size. The shutter is not vibrated if it is decided that the extracted size does not exceed the reference tablet size. In this method, the shutter is vibrated only when the tablet size to be packed is relatively big.

Figure 3:
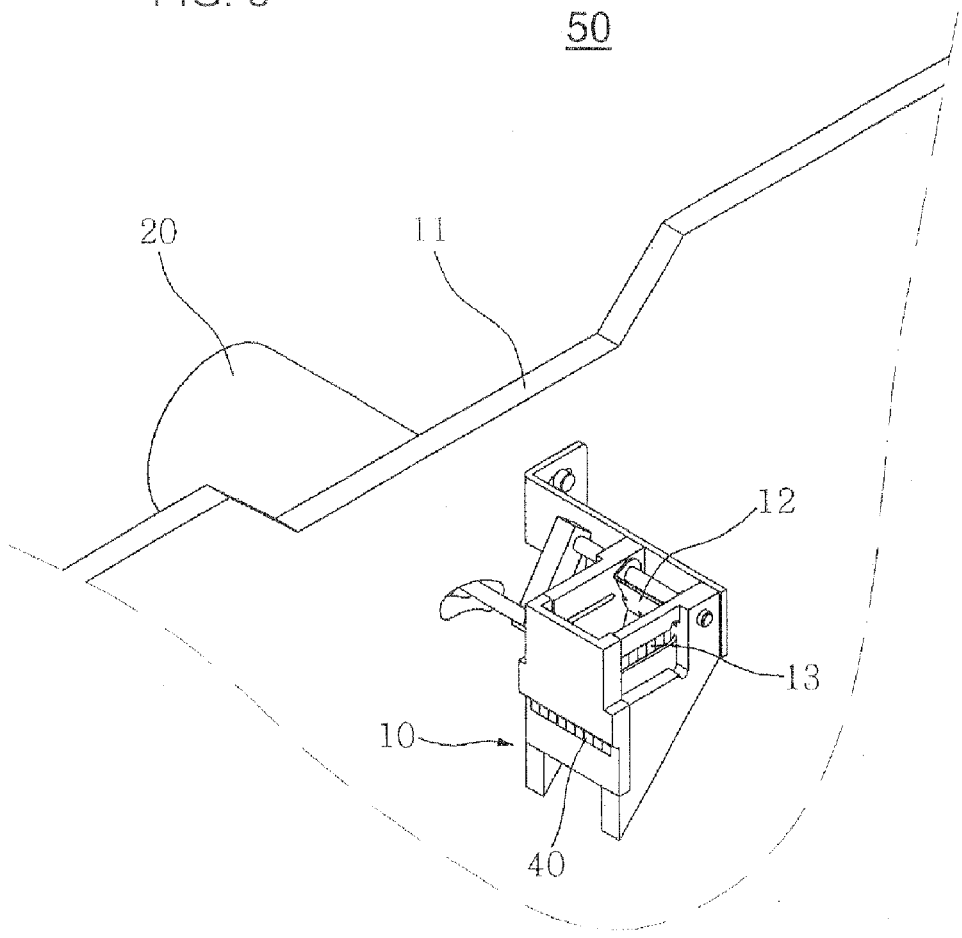
FIG. 3 is a perspective view showing a last hopper.
Figure 4:
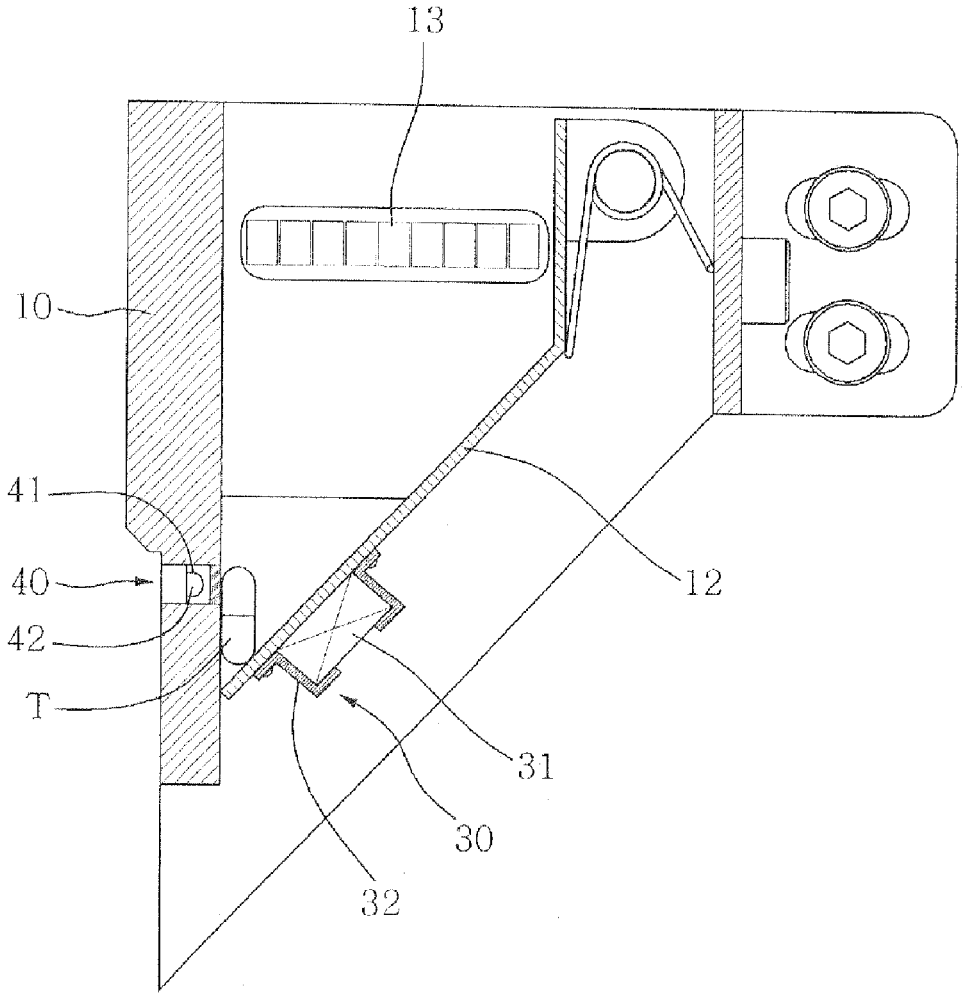
FIG. 4 is a cross-sectional view of the last hopper.

Referring to FIGS. 3 and 4, an apparatus 50 for preventing irregular packaging in an automatic medicine packing machine includes a last hopper 10, a shutter 12 that is installed on the lower part of the last hopper and opens or closes to receive a tablet discharged from a tablet cassette, a shutter drive unit 20 that moves the shutter 12, and a shutter vibrating unit 30 that vibrates the shutter.

The last hopper 10 is separately provided on a front surface of an installation plate 11 and has a lower open end that is covered by the shutter 12. The last hopper 10 carries a tablet just before it is packed.

An input sensor 13 is provided on the upper part of the last hopper 10 to sense whether a tablet is received in the last hopper 10.

The shutter drive unit 20 is separately provided on a rear surface of the installation plate 11, and drives the shutter 12 to open the last hopper 10 and discharge the tablet carried by the last hopper.

The shutter vibrating unit 30 is provided on an outer surface of the shutter 12 and vibrates the shutter 12 to make a vertical standing tablet fall down thereby preventing vertical standing of a tablet.

The shutter vibrating unit 30 includes a vibration motor 31 that is provided on the outer surface of the shutter 12 and generates vibration, and a fixing frame 32 that fixes the vibration motor 31 to the outer surface of the shutter 12 so that the vibration motor 31 is in close contact with the outer surface.

The apparatus for preventing irregular packaging in an automatic medicine packing machine further includes a standing sensor 40 that is provided on the last hopper 10 and senses whether a tablet received in the last hopper 10 stands vertical. The vibration motor 31 is operated only when the tablet is senses as standing vertical.

The standing sensor 40 includes a horizontal slot 41 that is formed horizontally at a side of the last hopper 10 at a position corresponding to a vertical height of a tablet and a photo sensor 42 that is horizontally arranged in the horizontal slot 41 and senses vertical standing of the tablet. The photo sensor 42 includes a plurality of photo sensing modules that are linearly arranged along the horizontal slot 41.

Figure 5:
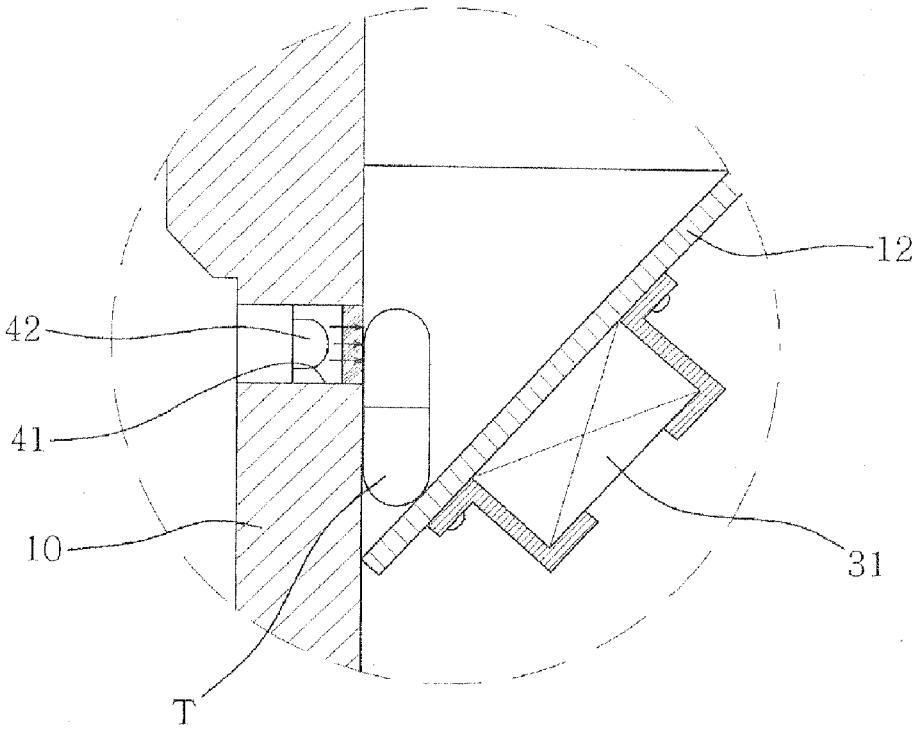
FIGS. 5 and 6 are enlarged partial cross-sectional views showing operation of the present invention.
Figure 6:
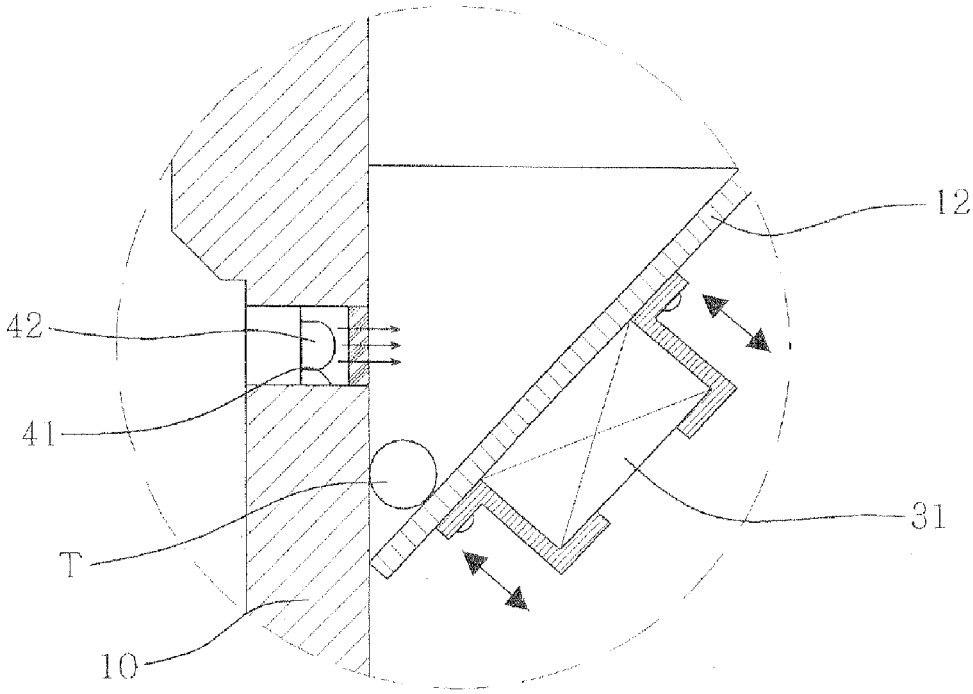
Figure 7:
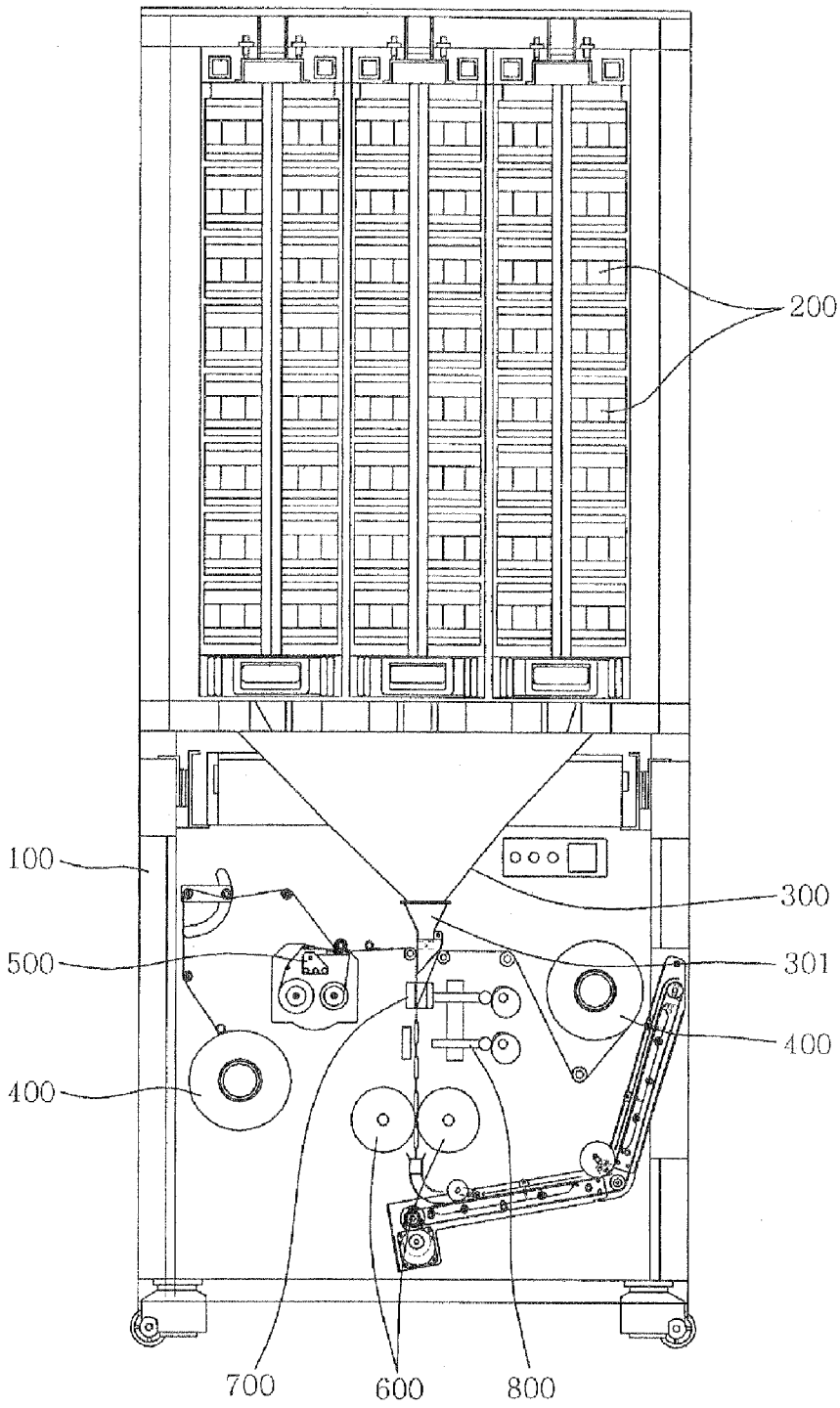
FIG. 7 is an elevation view showing an automatic medicine packing machine by prior art.
Figure 8:
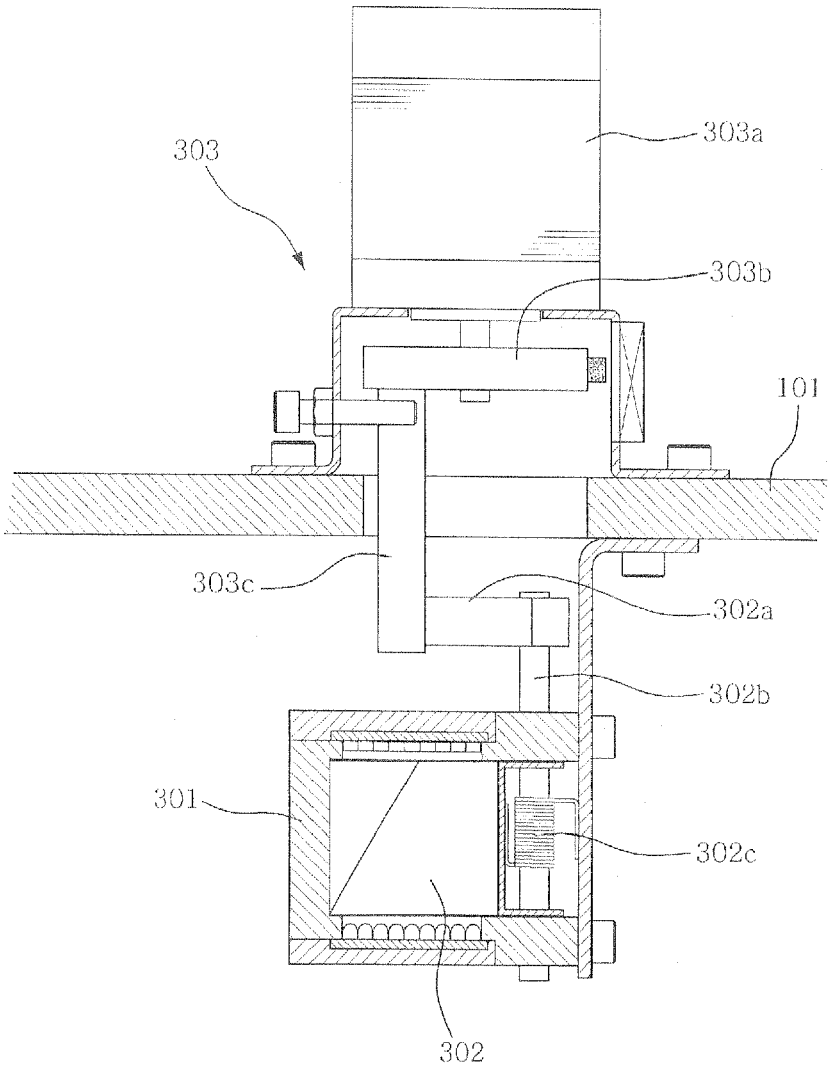
FIG. 8 is a cross-sectional view of a last hopper by prior art viewed from the top.
Figure 9:
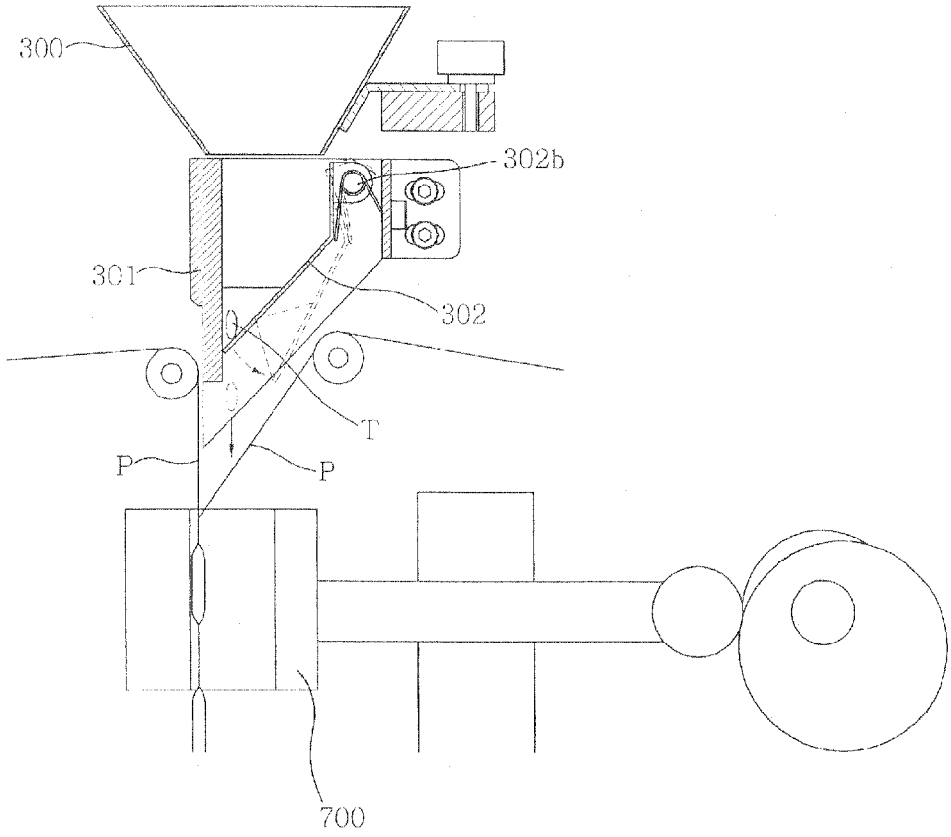
FIG. 9 is a cross-sectional view of the last hopper by prior art viewed from the front.

Referring to FIGS. 5 and 6, when a tablet is received in the last hopper 10 standing vertical, the upper end of the tablet is exposed to the photo sensor 42. The photo sensor 42 senses that the tablet stands vertical. This sensed information is transferred to the controller, and the controller operates the vibration motor 31 for a predetermined period of time making the shutter 12 vibrate so that the tablet falls down to horizontal state.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A method for preventing irregular packaging for automatic medicine packing machine that comprises a last hopper that receives a tablet discharged from a tablet cassette and contains the tablet just before the tablet is packed, wherein the last hopper comprises a shutter, the method comprises the steps of:

a) sensing whether a tablet is received in the last hopper;

b) sensing and deciding whether the tablet stands vertical inside the last hopper; and c) vibrating the shutter for a predetermined period of time if it is decided that the tablet stands vertical whereby the vertical standing tablet falls down.

2. The method of claim 1, further comprising a step of checking non-standing of the tablet, in which checking vertical standing of the tablet is performed with a standing sensor after completion of shutter vibration.

3. The method of claim 1, wherein in the step of sensing and deciding whether the tablet stands vertical, a photo sensor that is provided on the last hopper performs sensing standing status of the tablet.

4. A method for preventing irregular packaging for automatic medicine packing machine that comprises a last hopper that receives a tablet discharged from a tablet cassette and contains the tablet just before the tablet is packed, wherein the last hopper comprises a shutter, the method comprises the steps of:

a) sensing whether a tablet was discharged from the tablet cassette into the last hopper and stays inside the last hopper;

b) extracting size information of the tablet that is input into the last hopper from medicine data that is stored in a controller in advance;

c) comparing the extracted size of the tablet with a reference tablet size that is preset by an operator of the automatic medicine packing machine; and d) vibrating the shutter for a predetermined period of time if it is decided that the extracted size exceeds the reference tablet size.

5. An apparatus for preventing irregular packaging for automatic medicine packing machine that comprises a last hopper that receives a tablet discharged from a tablet cassette and contains the tablet just before the tablet is packed, wherein the last hopper comprises a shutter and a shutter drive unit that actuates the shutter to discharge the tablet, the apparatus comprising:

a shutter vibrating unit that is provided on an outer surface of the shutter and vibrates the shutter to prevent vertical standing of a tablet received in the last hopper.

6. The apparatus of claim 5, wherein the shutter vibrating unit comprises:

a) a vibration motor that is provided on the outer surface of the shutter and generates vibration; and b) a fixing frame that fixes the vibration motor to the outer surface of the shutter so that the vibration motor is in close contact with the outer surface.

7. The apparatus of claim 6, further comprising a standing sensor that is installed on the last hopper and senses whether the tablet received in the last hopper stands vertical.

8. The apparatus of claim 7, wherein the standing sensor comprises a horizontal slot that is formed horizontally at a side of the last hopper at a position corresponding to a vertical height of a tablet and a photo sensor that is horizontally arranged in the horizontal slot and senses vertical standing of the tablet.

* * * * *